US009462653B2

(12) United States Patent
Monjo

(10) Patent No.: US 9,462,653 B2
(45) Date of Patent: Oct. 4, 2016

(54) ILLUMINATION SYSTEM

(71) Applicant: DAISHO DENKI INC., Tokushima (JP)

(72) Inventor: Yoshio Monjo, Myozai-gun (JP)

(73) Assignee: DAISHO DENKI INC., Tokushima (JP)

( * ) Notice: Subject to any disclaimer, the term of this patent is extended or adjusted under 35 U.S.C. 154(b) by 0 days.

(21) Appl. No.: 14/907,974

(22) PCT Filed: Oct. 20, 2014

(86) PCT No.: PCT/JP2014/077876

§ 371 (c)(1),
(2) Date: Jan. 27, 2016

(87) PCT Pub. No.: WO2015/060270

PCT Pub. Date: Apr. 30, 2015

(65) Prior Publication Data

US 2016/0174325 A1 Jun. 16, 2016

(30) Foreign Application Priority Data

Oct. 22, 2013 (JP) ..... 2013-219691

(51) Int. Cl.
*H05B 33/08* (2006.01)

(52) U.S. Cl.
CPC ..... *H05B 33/0863* (2013.01); *H05B 33/0851* (2013.01); *H05B 33/0869* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,319,425 | B1 | 11/2001 | Tasaki et al. | |
| 2009/0097746 | A1* | 4/2009 | Shinjo | G06K 9/2018 382/168 |
| 2009/0115344 | A1 | 5/2009 | Baik et al. | |
| 2009/0153450 | A1* | 6/2009 | Roberts | H05B 33/086 345/84 |
| 2014/0043379 | A1 | 2/2014 | Suzuki | |

FOREIGN PATENT DOCUMENTS

| | | |
|---|---|---|
| JP | 2007-227678 | 9/2007 |
| JP | 2008-270831 | 11/2008 |
| JP | 2009-117339 | 5/2009 |
| JP | 2009-302008 | 12/2009 |

(Continued)

OTHER PUBLICATIONS

International Search Report issued Jan. 20, 2015 in International Application No. PCT/JP2014/077876.

*Primary Examiner* — Douglas W Owens
*Assistant Examiner* — Jianzi Chen
(74) *Attorney, Agent, or Firm* — Wenderoth, Lind & Ponack, L.L.P.

(57) ABSTRACT

An illumination system includes different color LEDs, a controller, and an input device. The controller controls intensities of the LEDs. The input device accepts an input corresponding to a total color of the LEDs. The input device includes a display, a pointer, and an output circuit. The display displays a chromaticity diagram. The pointer specifies a color point in the diagram. The output circuit detects the coordinates of the point and provides them to the controller. The controller includes a limiter, and a calculator. The limiter provides a limiter signal for limiting the maximum output the LED. The calculator calculates outputs of the LEDs based on the coordinates and the limiter signal so that the total color is adjusted to the point.

10 Claims, 4 Drawing Sheets

(56) References Cited

FOREIGN PATENT DOCUMENTS

| | | |
|---|---|---|
| JP | 2010-505226 | 2/2010 |
| JP | 2010-528432 | 8/2010 |
| JP | 2012-506614 | 3/2012 |
| WO | 2008/038180 | 4/2008 |
| WO | 2008/147753 | 12/2008 |
| WO | 2010/047777 | 4/2010 |
| WO | 2012/090154 | 7/2012 |
| WO | 2012/147442 | 11/2012 |

* cited by examiner

ILLUMINATION SYSTEM

BACKGROUND OF THE INVENTION

1. Field of the Invention

The present invention relates to an illumination system that can control light outputs of LEDs with different light colors whereby adjusting the light color of the illumination system to various colors.

2. Description of the Related Art

An illumination system has been developed as lighting fixture which controls light outputs of LEDs with different light colors whereby emitting particular color light.

See Japanese Patent Laid-Open Publication No. 2008-270,831 A.

This illumination system adjusts light outputs of LEDs with different light colors so that the total light color of the illumination system is adjusted to particular color light by mixing the adjusted light outputs of LEDs. For example, the light outputs of blue, red and green light color LEDs can be controlled so that blue light, red light, and green light are mixed at a particular ratio in which human eyes recognize the mixed total light as white light. In addition, the light color of the illumination system can be adjusted to colors in the full color range by controlling light outputs of LEDs. In order to adjust the mixed total light to a particular color, this illumination system accepts x and y input values of the chromaticity coordinates, and adjusts the total light color of the illumination system to the light color corresponding to the input values of the chromaticity coordinates.

In the illumination system which controls light outputs of LEDs and adjusts the total color light of the illumination system, in order to specify a particular total color light, it is necessary to provide x and y values of the chromaticity coordinates. Accordingly, there is a problem that not all users can easily obtain the particular total color to which they intend to adjust the total color light of the illumination system. The reason is that users are required to see the chromaticity coordinate diagram to specify x and y values, and to enter the specified x and y values into the illumination system so that the illumination system accepts the particular color light.

To solve the above problem, it is a first object of the present invention to provide an illumination system that allows all users to easily, simply and surely obtain particular color light to which they intend to adjust the total color light of the illumination system.

The light color of the above known illumination system can be adjusted by specifying coordinates, such as x and y values of the chromaticity coordinates. However, in the case where the light outputs of LEDs are controlled in order to adjust the light color of the illumination system, the peak output of one of the LEDs may become substantially higher. In this case, users' eyes or brains may be relatively strongly stimulated, which in turn may cause undesired effects on their eyes or brains. In this case, since users will recognize the mixed total color light, they may not feel the effects.

It is a second object of the present invention to provide an illumination system that allows users to obtain particular color light to which they intend to adjust the total color light of the illumination system while preventing undesired effects on users' eyes or brains.

SUMMARY OF THE INVENTION

An illumination system according to the present invention includes LEDs 1, a control circuit 2, and an input device 3.

The LEDs emit light in different colors. The control circuit controls light intensities of the LEDs 1. The input device is connected to the control circuit 2, and accepts an input corresponding to a total light color to be obtained by mixing the light colors of the LEDs 1. The input device 3 includes a color display portion 8, a color-point pointer 9, and an output circuit 10. The color display portion 8 displays a chromaticity diagram 13 in color. The color-point pointer 9 specifies a color point P in the chromaticity diagram 13, which is displayed on the color display portion 8. The output circuit 10 detects the coordinates of the color point P, which is specified by the color-point pointer 9, and provides the detected coordinates to the control circuit 2. The control circuit 2 includes a limiter circuit 5, and a calculator circuit 4. The limiter circuit 5 provides a limiter signal for limiting the maximum output at the peak wavelength of the LED 1. The calculator circuit 4 calculates light outputs of the LEDs 1 based on the limiter signal, which is provided from the limiter circuit 5, in addition to the coordinates, which are provided from the input device 3. In the illumination system, the control circuit 2 controls light outputs of the LEDs 1 based on the coordinates (e.g., x and y values), which are provided from the input device 3, and the limiter signal, which is provided from the limiter circuit 5, whereby adjusting the total light color of the LEDs 1 to the color point P, which is specified by the color-point pointer 9 of the input device 3.

According to the above illumination system, all users can easily, simply and surely obtain particular color light to which they intend to adjust the total color light of the illumination system. The reason is that, in the above illumination system, the color point corresponding to the particular total light color can be specified not by entering the coordinates (e.g., x and y values) but by an input on the chromaticity diagram, which is displayed in full color, so that the total light color is adjusted to the light color corresponding to the specified color point.

In addition, the above illumination system has an advantage that the total color light of the illumination system can be adjusted to color light corresponding to the color point, which is specified by users, while preventing undesired effects on users' eyes or brains. The reason is that the above illumination system includes the limiter circuit that provides a limiter signal for limiting the maximum output at the peak wavelength of the LED, and the light outputs of the LEDs are controlled based on the limiter signals provided from the limiter circuit as well as the coordinates (e.g., x and y values) that indicate the color point so that the total light color is adjusted to the specified particular color point.

In the illumination system, the input device 3 can include a use input portion 7 that accepts an input for specifying a use type of the illumination system, and the limiter circuit 5 can store limiter signals of the LED 1 corresponding to use types to be provided from the use input device 7. In addition to this, light outputs of the LEDs 1 can be controlled based on the limiter signal that is selected corresponding to the use that is specified in the use input portion 7 from the limiter signals stored in the limiter circuit 5.

The above illumination system has an advantage that the total color light of the illumination system can be adjusted to color light corresponding to the color point, which is specified by users, and the light emission is optimized in accordance with the use type of the illumination system to avoid stimulating users' eyes or brains too much.

In the illumination system, the input device 3 can include a light intensity input device 12 that accepts an input for specifying a total light intensity of the LEDs 1, and light outputs of the LEDs 1 can be controlled based on the light intensity signal that corresponds to the input and is provided from the light intensity input device 12, x and y values that are provided as the coordinates from the input device 3, and the limiter signal, which is provided from the limiter circuit 5.

The above illumination system has an advantage that the total color light of the illumination system can be adjusted to color light corresponding to the color point, which is specified by users, while adjusting the light output of the total color light of the illumination system to the optimal intensity for users.

The illumination system can further include a light output detection circuit 14 that detects the total light color of the LEDs 1, and the control circuit 2 can includes a feedback circuit. The total light color that is detected by the light output detection circuit 14 can be compared with the color point, which is specified by the input device 3, so that the total light color of the LEDs 1 can be corrected to the color point, which is specified by the input device 3. According to the above illumination system, since the total light color of the LEDs 1 can be corrected to the color point, which is specified by the input device 3, based on the detection of the total light color of the LEDs 1 detected by the light output detection circuit 14, the total light color of the LEDs can be more accurately adjusted to the color point, which is specified by the coordinates (e.g., x and y values). In addition, the above illumination system has an advantage that, in the case where the system includes a plurality of LEDs, even if any of the LEDs cannot emit light or deteriorate in light output, or if light from the outside is incident on the light emitting part of illumination system, the total light color can be adjusted to the color point, which is specified by the input device 3.

In the illumination system, the chromaticity diagram can be the x-y chromaticity diagram, and the coordinates can be x and y values. Also, chromaticity diagram can be the UCS diagram, and the coordinates can be u and v values.

In the illumination system, the input device 3, the color-point pointer 9 can include a photo sensor that detects red, green and blue components R, G and B of a specified area in the color display portion 8. The red, green and blue components R, G and B, which are detected by the photo sensor, can be provided as the coordinates to the control circuit 2. According to the above illumination system, since the red, green and blue components R, G, B are provided from the color-point pointer, the calculator circuit of the control circuit can calculate and determine light outputs of the LEDs based on the RGB outputs, which are provided from the color-point pointer, without converting x and y values or UV address in the chromaticity diagram so that the LEDs can emit light based on the calculated light outputs.

The illumination system can further include a diffusion plate that is arranged on the light-outgoing side relative to the LEDs 1 and diffuses light that is emitted by the LEDs 1. According to the above illumination system, since light that is emitted by the LEDs can be diffused by the diffusion plate, the light can be uniformly emitted while avoiding stimulating users' eyes too much when users look at the LEDs.

DETAILED DESCRIPTION OF THE EMBODIMENT(S)

Figure 1:
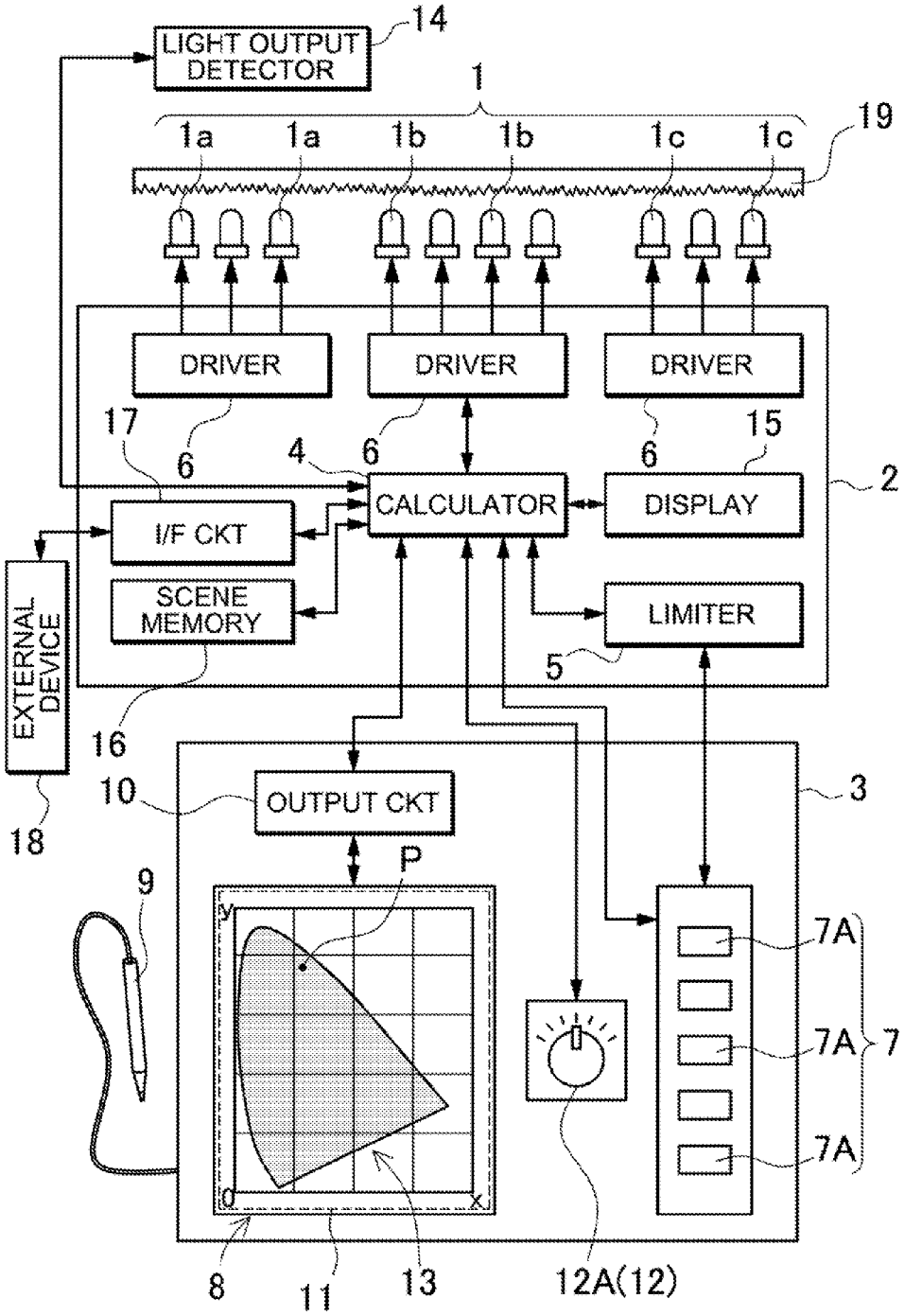
FIG. 1 is a schematic block diagram showing an illumination system according to an embodiment of the present invention.

The following description will describe embodiments according to the present invention with reference to the drawings. It should be appreciated, however, that the embodiments described below are illustrations of an illumination system to give a concrete form to technical ideas of the invention, and an illumination system of the invention is not specifically limited to description below. In this specification, reference numerals corresponding to components illustrated in the embodiments are added in "CLAIMS" and "SUMMARY OF THE INVENTION" to aid understanding of claims. However, it should be appreciated that the members shown in claims attached hereto are not specifically limited to members in the embodiments.

An illumination system shown in FIG. 1 includes LEDs 1, a control circuit 2, an input device 3, and a light output detection circuit 14. The LEDs emit light in different colors. The control circuit controls light intensities of the different light emission color LEDs 1. The input device accepts an input for specifying a color point of the total light color of all of the LEDs 1, which emit light based on the control by the control circuit 2. The light output detection circuit detects the total color of light that is emitted by the LEDs 1. This illumination system controls light outputs of the LEDs 1 by using the control circuit 2 so that total light color of the LEDs 1 is adjusted to a color point that is specified by using the input device 3. In this illumination system, since the total light color of the LEDs 1 is detected by the light output detection circuit 14, and is provided as feedback to the control circuit 2, the total light color of the LEDs 1 is accurately adjusted to the light color corresponding to the color point. However, the illumination system according to the present invention does not necessarily include the light output detection circuit. In this case, light outputs of the LEDs are controlled by the control circuit so that total light color can be adjusted to the color point, which is specified by using the input device.

Figure 3:
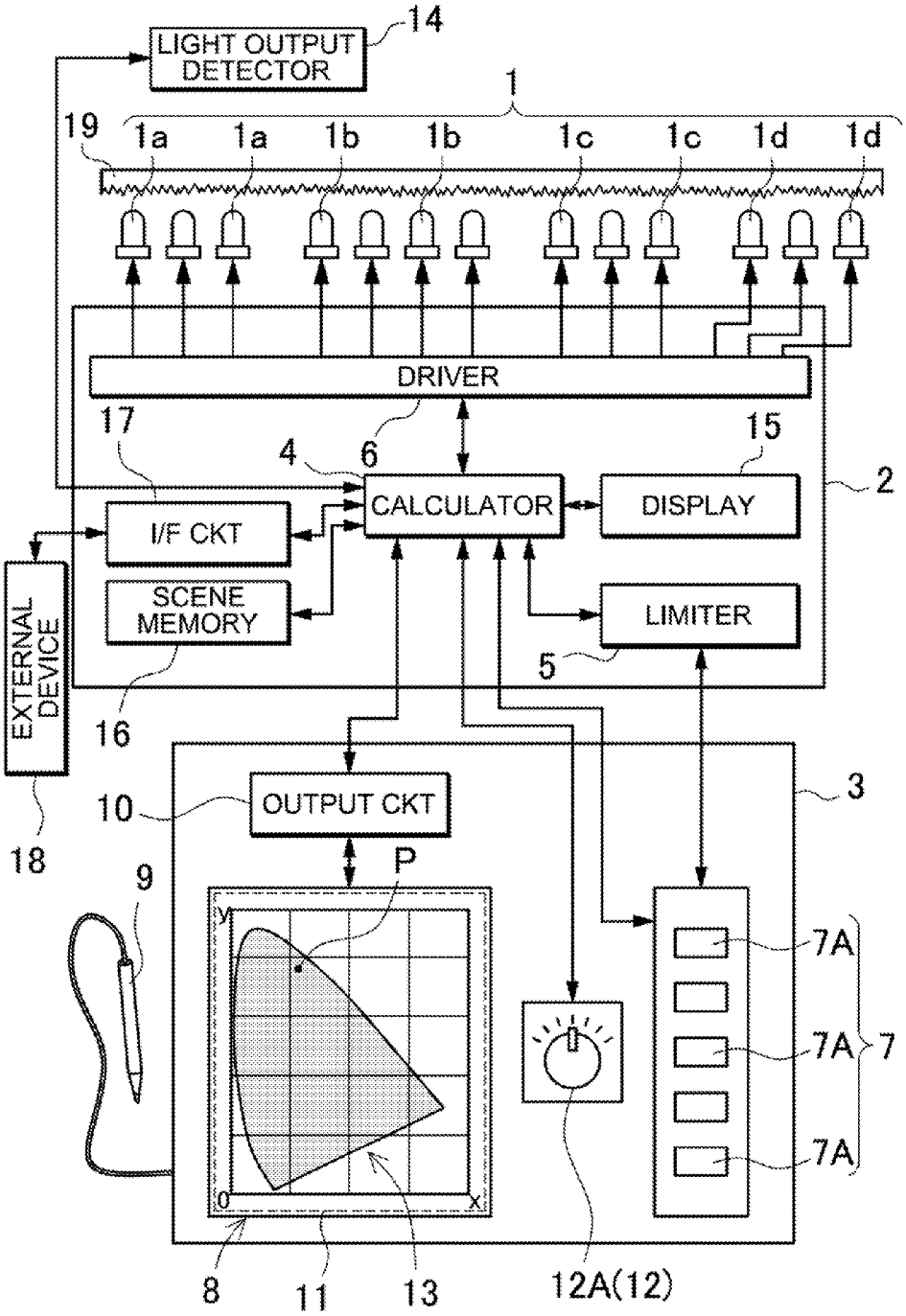
FIG. 3 is a schematic view showing an illumination apparatus according to another embodiment of the present invention.
Figure 4:
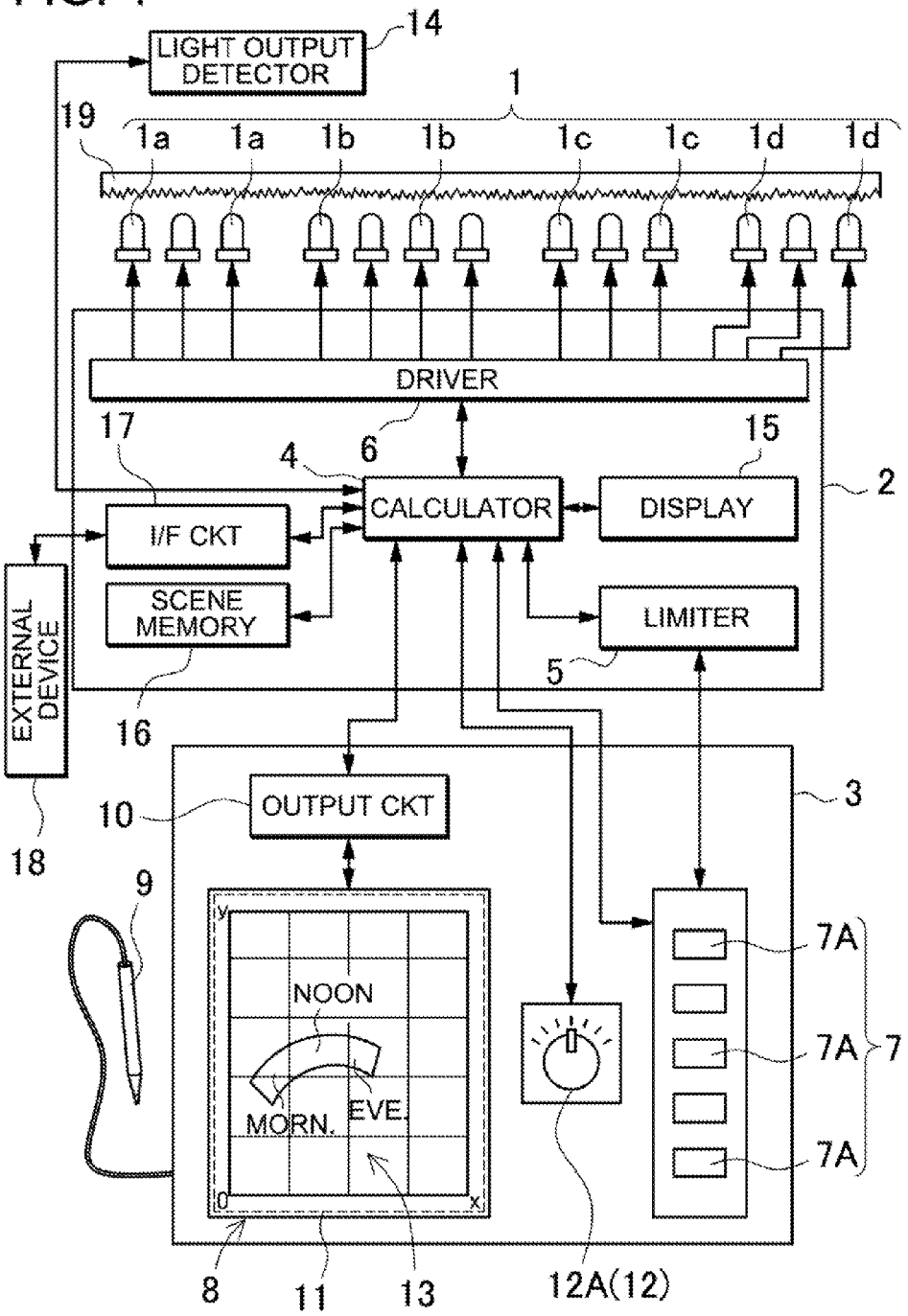
FIG. 4 is a schematic block diagram showing an illumination apparatus shown in FIG. 3 with another exemplary color display portion being illustrated in front view.

Red, green and blue light emission color LEDs 1*a*, 1*b* and 1*c* are provided as the different light color LEDs 1. Hereinafter, the red, green and blue light color LEDs are occasionally referred to as red, green and blue (RGB) LEDs. The illumination system including LEDs that emit light in three primary colors (i.e., RGB) as the LEDs 1 can adjust its total light color in the full color range by controlling light outputs of the LEDs 1. However, the LEDs in the illumination system according to the present invention are not limited to LEDs that emit light in three primary colors (i.e., RGB). The illumination system can include various white LEDs and other light color LEDs. For example, in the case where the illumination system includes white LEDs 1*d*, and the blue, green and red LEDs 1*c*, 1*b* and 1*a* as shown in FIG. 3 and FIG. 4, the total light color can be adjusted in the range from nearly white to nearly blue, green and red.

In the illumination system shown in FIG. 1, a plurality of LEDs as LEDs 1 are provided for each of RGB colors whereby increasing the total light output of the illumination system. In other words, the illumination system shown in FIG. 1 includes a plurality of red LEDs 1*a*, a plurality of green LEDs 1*b*, and a plurality of blue LEDs 1*c*. The total light output of the illumination system increases as the number of LEDs 1 corresponding to each light color increases. In the illustrated illumination system, a plurality of blue LEDs 1*c*, a plurality of green LEDs 1*b*, and a plurality of red LEDs 1*a* are provided in order to increase the total light output of the illumination system. The light output of the illumination system is adjusted to the optimal value depending on its use type. The number of the LEDs 1 corresponding to each light color is adjusted to the optimal number depending on its use type, and the light output of the illumination system is controlled to the optimal value. In the case where the illumination system includes a plurality of LEDs 1 as LEDs 1 corresponding to each light color, since the light outputs of different color LEDs 1 are not always the same as each other, the numbers of LEDs 1 corresponding to the different colors may be adjusted to different numbers from each other so that the light output of the illumination system can be controlled whereby obtaining the optimal balance.

A diffusion plate 19 is arranged on the light-outgoing side (front side) relative to the LEDs 1. The diffusion plate 19 is a filter formed of paper, glass, plastics, plastic film or the like. Light from the LEDs 1 is diffused toward the light-outgoing side (frontward) when passing through the diffusion plate. Microscopic asperities are formed on the surface of the diffusion plate 19. Alternatively, the diffusion plate can have a diffusion material, or strain or the like inside the diffusion plate. Thus, light passing through the diffusion plate is diffused. In the case where the illumination system includes the diffusion plate 19 for diffusing light emitted from the LEDs 1, light can be uniformly diffused. Also, in this case, the illumination system has an advantage that users' eyes are not stimulated too much when users look at the LEDs. The diffusion plate 19 may be removed depending on the use type of the light output.

The total light color of the LEDs 1 (i.e., the light color that perceived by users' eyes after light emitted by the RGB LEDs 1 is mixed) is adjusted to a particular light color corresponding to the color point P, which is specified by using the input device 3. This is achieved by controlling light outputs of the LEDs 1 by using the control circuit 2. The control circuit 2 includes a calculator circuit 4 that calculates light outputs of the LEDs 1 based on the coordinates (e.g., x and y values) of the color point P, which is specified by using the input device 3. After the calculator circuit 4 calculates light outputs of the different color LEDs 1, the different color LEDs emit the calculated outputs (amounts) of light in different colors. In the illustrated control circuit 2, a display portion 15 is connected to the calculator circuit 4. The display portion 15 displays x and y values or u and v values, which are coordinates of the total light color of LEDs 1, or light intensities of the RGB LEDs 1. In the case where the system displays the x-y chromaticity diagram as a chromaticity diagram, x and y values are displayed. In the case where the system displays the UCS diagram as a chromaticity diagram, u and v values are displayed. The display portion 15 may display outputs of the LEDs 1*a*, 1*b* and 1*c* corresponding to the RGB colors.

Also, users can check the display on the display portion 15, and then change the total light color by using the input device 3. When the total light color is changed, control data corresponding to the changed total light color is provided to the driver circuit through the calculator circuit so that outputs of the LEDs can be controlled. Optionally, the display portion can include a sub-input device (not shown). In this case, users can change the display by using the sub-input device. When the total light color is changed, control data corresponding to the changed total light color is provided to the driver circuit through the calculator circuit so that outputs of the LEDs can be controlled. In this illumination system, the control data corresponding to the display change, which is changed in the display portion 15, is transmitted to the input device 3 so that the display point corresponding to the present control data can be highlighted. In addition, the display portion 15 can show the hue, lightness, color saturation and the like of colors of light that are emitted by the LEDs.

Although the x-y chromaticity diagram is used as the chromaticity diagram in the embodiment described below, the UCS diagram can be used as the chromaticity diagram in the illumination system according to the present invention. In the case where the chromaticity diagram of the system is the UCS diagram, u and v values are used as the coordinates. The u and v values can be converted from x and y values based on the known particular formula.

The light output detection circuit 14 detects the total light color of the LEDs 1 with the LEDs 1 emitting light, and can convert the light color into signal values of the detected light color (i.e., RGB values, x and y values and luminance value). The signal values can be provided as feedback to the control circuit 2.

The control circuit 2 controls light outputs of the LEDs 1 not only based on the calculation of the color point, which is provided from the input device 3. The control circuit 2 further includes a limiter circuit 5 that limits the maximum outputs at the peak wavelengths of the different color LEDs 1. Thus, the control circuit controls light outputs of the LEDs based on the limitations by the limiter circuit in addition to the light intensities of the LEDs and the color point, which are provided from the input device 3. The limiter circuit 5 provides a limiter signal to the calculator circuit 4.

The calculator circuit 4 includes a main CPU. The main CPU is connected to sub-CPUs through an address bus and data bus, and a connection lines such as interrupt control line. The sub-CPUs are included in the light output detection circuit 14, the driver circuit 6, the display portion 15, the limiter circuit 5, an interface circuit 17, a scene memory 16, an output circuit 10 of the input device 3, a color display portion 8, a color-point pointer 9, a light intensity input portion circuit 12, a use input portion 7, and the like. The main CPU of the calculator circuit controls bidirectional data communication with the sub-CPUs, which are connected to the main CPU through the address bus, the data bus and the interrupt line. However, the sub-CPUs are not necessarily provided to the above elements. The calculator circuit may include the sub-CPU for controlling the above elements based on signals from the main CPU.

The calculator circuit 4 calculates the coordinates, and the limiter signals. The coordinates specify the color point P, which is provided from the input device 3. The limiter signals are provided from the limiter circuit 5. The calculator circuit calculates control data that specifies light outputs of the LEDs 1 based on the calculation of the coordinates and the limiter signals. The control data is provided to the driver circuits 6 so that the LEDs 1 emit the specified outputs of light. The coordinates, which are provided to the calculator circuit 4, are x and y values in the x-y chromaticity diagram, or u and v values in the UCS diagram. In addition, the red component (R), green component (G) and blue component (B) that are detected by a photo sensor can be provided to the calculator circuit.

The limiter circuit 5 stores the limiter signals for limiting the maximum outputs of the LEDs 1 depending on the use type of the illumination system. The illumination system according to the present invention adjusts light outputs of different color LEDs 1 so that users can perceive the total light color of LEDs 1 as the color point P, which is perceived by users' eyes and then specified by the users. According to this adjustment, users will perceive the light color of the illumination system as the color point P, which is specified by the users. However, if the light output at the peak wavelength is too high in any of the LEDs 1, undesired effects may be produced on users' eyes or brains. Unfortunately, when users perceive the light color of the illumination system as the color point P, which is specified by using the input device 3, even if the light emitting peak at the particular peak wavelength is too high in one of LEDs 1, the users cannot immediately recognize that the too much light emission peak causes undesired effects on their eyes or brains. Users will perceive light exhibiting the total light color. If the LED 1 emits light with narrow band spectrum and high light emission peak, users cannot recognize only this high peak light component. Since users will perceive light exhibiting the total light color, they cannot immediately recognize that the too much light emission peak causes undesired effects on their eyes or brains. For this reason, even if the total light color is adjusted to the light corresponding to the specified color point, the light emission peak of the particular LED may cause undesired effects on their eyes or brains. The response of human eyes is low for the blue light peak of blue LED. For example, in the case where the illumination system is used in a bright condition, it is necessary to increase the light output of the blue LED so that the light color of the illumination system is adjusted to the specified color point (e.g., white). In this case, although users perceive the light color of the illumination system as white, they cannot recognize the high blue peak light. For example, if the blue peak light becomes too high, undesired effects may be produced on users' eyes or brains.

In order to prevent the aforementioned problem, the control circuit 2 includes the limiter circuit 5, which provides the limiter signals for limiting the maximum outputs at the peak wavelengths of LEDs 1, in the illumination system shown in FIG. 1. The control circuit 2 controls light outputs of the LEDs 1 based on x and y values, which specify the color point P, as well as the limiter signals, which are provided from the limiter circuit 5, so that the total light color is adjusted to the particular color point. The control circuit 2 can provide the limiter signals, which are stored in the limiter circuit 5, to the calculator circuit 4. The calculator circuit 4 calculates control data for adjusting the light emission peaks of the LEDs 1 to values not exceeding their maximum outputs. The light emission of the LEDs 1 is controlled based on the control data. In the case where the limiter circuit 5 limits the light emission peak of a particular LED 1 to its maximum output, the control circuit 2 suppresses the total light output while adjusting the total light color to the specified color point, or adjusts the total light color to a color that is slightly shifted from the specified color point. Depending on the use type of the illumination system, the control circuit 2 can suppress the total light output while adjusting the total light color to the specified color point, or adjust the total light color to a color that is slightly shifted from the specified color point. For example, in the case of the use type where the total light color is considered important and the light output can be suppressed, for example, in the use type where the illumination system is used in relaxation environments in which users relax in their home, the total light color is adjusted to the color point, while the light output is suppressed. In the office or school environments, the total light color is adjusted to a color that is slightly shifted from the color point without suppressing the light output.

In the illumination system shown in FIG. 1, the limiter circuit 5 stores the limiter signals of the LEDs 1 corresponding to the various use types. The use type of the illumination system is provided from the use input portion 7, which is included in the input device 3. The limiter circuit 5 stores optimal limiter signals corresponding to the office environments where the illumination system is used in offices, the school environments where the illumination system is used for learning in schools or homes, the relaxation environments where users relax in their homes, and the like. For example, in the office or school environments, the maximum outputs at the light emitting peaks of the LEDs 1 can be high as compared with the relax environments so that the work or learning efficiency can be high. In the relaxation environments, the maximum outputs at the light emitting peaks of the LEDs 1 can be low so that undesired effects on users' eyes or brains can be reduced. In the illumination system that adjusts the maximum outputs at the light emitting peak of the LEDs 1 to the optimal values depending on the use type of the illumination system, the total color light of the illumination system can be adjusted to color light corresponding to the color point, which is specified by users, while more effectively preventing undesired effects on users' eyes or brains. The calculator circuit 4 calculates control data for limiting light outputs of the LEDs 1 based on x and y value of the color point P as well as the limiter signals, which are provided from the limiter circuit 5. The control circuit 2 shown in FIG. 1 includes the scene memory 16, which stores scene data corresponding to the various use types calculated by the calculator circuit 4. When a use type is provided from the use input portion 7 to the control circuit 2, the scene data corresponding to the provided use type is read from the scene memory 16. Subsequently, control data is calculated and provided to the driver circuits 6. Thus, the driver circuits 6 control light outputs of the LEDs 1 based on the provided control data.

Although the illumination system shown in FIG. 1 includes the use input portion 7 in the input device 3, a separate external connection device 18 (e.g., personal computer, dedicated terminal, and mobile phone) may be connected to the interface circuit 17 as shown in FIG. 1 so that the color point, light output, use type, and the like may be provided from the external connection device 18.

The control circuit 2 in FIG. 1 includes the driver circuits 6 for adjusting light outputs of the LEDs 1 based on the control signals, which are provided from the calculator circuit 4. The driver circuits 6 control light outputs of the LEDs 1 by controlling electric currents that flow through the LEDs 1 based on the control signals, which are provided from the calculator circuit 4. The control signals can be voltage or current signals. The driver circuits 6 can be constructed of bipolar transistors or FETs. Thus, electric currents flowing through the LEDs 1 are controlled based on the provided control signals so that the light outputs are controlled. In the case where the driver circuits are constructed of FETs, the control signals are voltage signals, and the electric currents flowing through the LEDs 1 are controlled based on the voltage signals. In the case where the driver circuits are constructed of bipolar transistors, the control signals are current signals, and the light outputs are controlled based on electric currents. As a result, the light outputs of the LEDs can be controlled by controlling electric currents flowing through the LEDs.

In the illumination system shown in FIG. 1, the control circuit 2 includes a feedback circuit that compares the total light color that is detected by the light output detection circuit 14 with the color point, which is specified by the input device 3, whereby correcting the total light color of the LEDs 1 to the color point, which is specified by the input device 3. According to this illumination system, since the total light color of LEDs 1 is corrected to the color point in accordance with the total light color that is detected by the light output detection circuit 14, the total light color of the LEDs can be more accurately adjusted to the color point. In this illumination system, the calculator circuit 4 included in the control circuit 2 compares the total light color that is detected by the light output detection circuit 14 with the color point, which is specified by using the input device 3, and calculates the light outputs of the LEDs 1 so that the total light color of the LEDs is adjusted to the color point. Also, in the case where the total light color is corrected to the color point, the calculator circuit 4 calculates light outputs of the LEDs 1 based on the limiter signals, which are provided from the limiter circuit 5, and the total light color that is provided from the light output detection circuit 14 so that the outputs at the peak wavelengths of the LEDs 1 do not exceed the maximum outputs of the LEDs.

The input device 3 includes the color display portion 8, the color-point pointer 9, and the output circuit 10. The color display portion 8 displays the chromaticity diagram 13 in full color. The color-point pointer 9 specifies a color point P in the chromaticity diagram 13, which is displayed on the color display portion 8. The output circuit 10 detects the x and y values of the color point P, which is specified in the chromaticity diagram by the color-point pointer 9, and provides the detected coordinates to the control circuit 2.

In the input device 3, the color-point pointer 9 is brought in contact with a particular color point P on the chromaticity diagram 13, which is displayed on the color display portion 8, or is pressed down at a particular color point on the chromaticity diagram. Alternatively, a particular color point can be specified by striking light at the particular color point. Thus, the x and y values of the specified color point P can be determined. The color display portion 8 can include a location detector 11 the surface of which the full color chromaticity diagram is printed on. The location detector can be constructed of a digitizer, touch panel, photo sensor, resistor sensor or the like. In the case of the resistor sensor, the address can be specified by its resistance values. Alternatively, the color display portion 8 can include a monitor that displays the full color chromaticity diagram, and a location detector for detecting the location where the color-point pointer 9 is brought in contact or pressed down, or light strikes.

Figure 2:
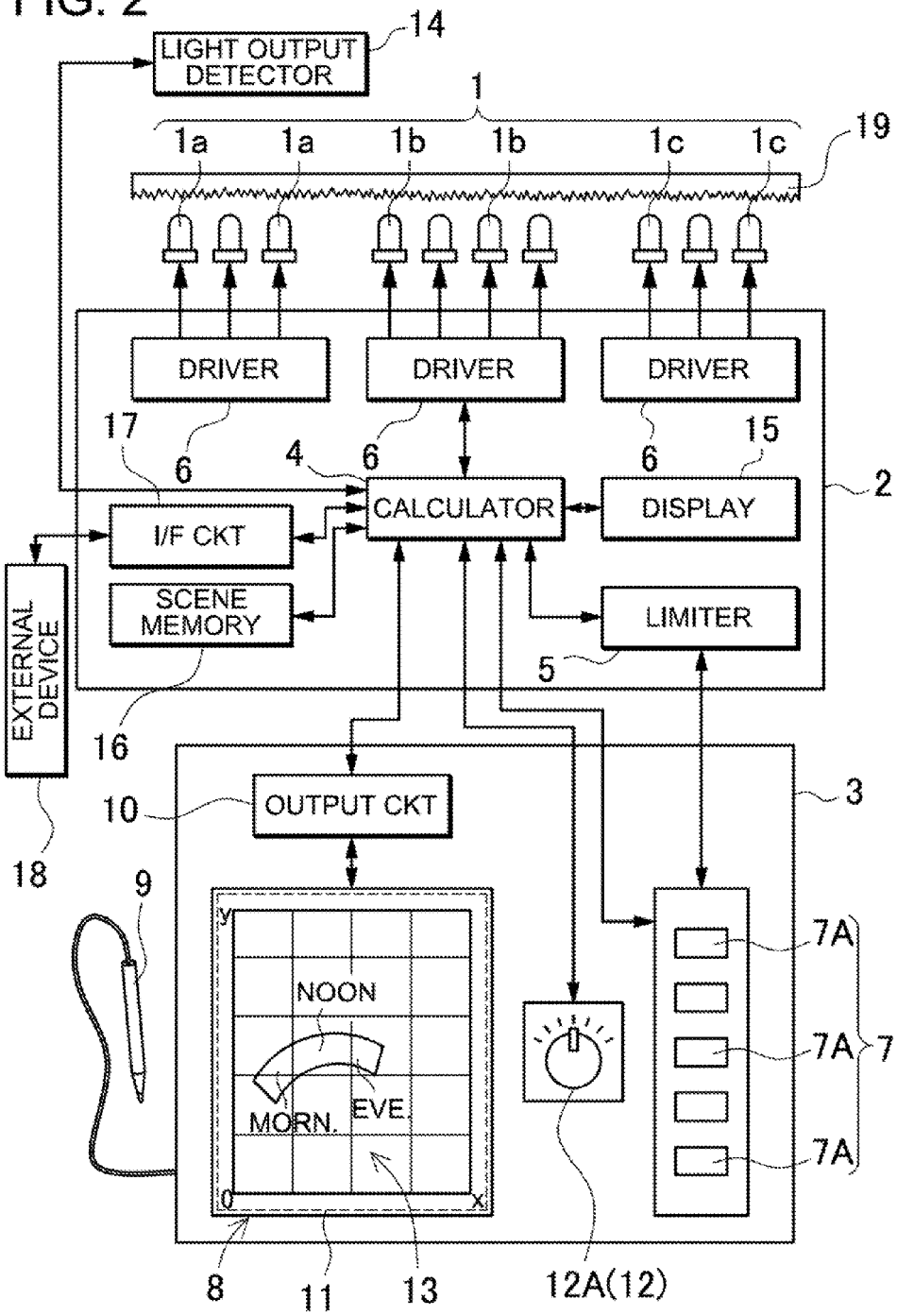
FIG. 2 is a schematic block diagram showing an illumination system shown in FIG. 1 with another exemplary color display portion being illustrated in front view.

The color display portion 8 shown in FIG. 1 displays the entire chromaticity diagram 13 on its surface. Although not illustrated, the color display portion may display a part of enlarged chromaticity diagram, or a plurality of divided parts of the chromaticity diagram. The color display portion shown in FIG. 2 displays light colors from morning to noon, and from daytime to evening so that users can adjust the total light color to a light color in the range from morning to evening. When the input device that includes a digitizer or touch panel in the color display portion is pressed by or contact with by the color-point pointer at a particular point, the location of the particular point is determined and provided to the output circuit. The x and y values of the particular point are determined in the output circuit. In the case where the input device includes a photo sensor in the color display portion, when light from the color-point pointer strikes a particular point on the chromaticity diagram, which is displayed on the color display portion, the photo sensor determines the location where the light strikes. The x and y values are detected based on the location signal by the output circuit, and are provided to the control circuit. The color-point pointer 9 of the input device may include full-color photo sensor that can detect light reflected from the chromaticity diagram of the color display portion 8. The full-color photo sensor is accommodated in the color-point pointer 9, and detects red, green and blue components (R, G, B) of light that are reflected from a particular area in the chromaticity diagram when specifying the particular area in the chromaticity diagram. The input device obtains the x and y values as the coordinates based on the reflected light detected by the full color photo sensor, which is accommodated in the color-point pointer 9, and provides these x and y values to the control circuit. This input device may provide values of the red, green and blue components (R, G, B) as the coordinates that are detected by the photo sensor, which is accommodated in the color-point pointer 9, to the control circuit. This input device does not necessarily include the sensor for detecting the pressed or touch location, or the sensor for detecting the location of the color display portion where light strikes. Accordingly, this input device can be simplified since the chromaticity diagram can be printed on a simple flat plate. The color display portion can be a monitor or the like that displays the chromaticity diagram in full color.

The output circuit 10 calculates x and y values based on the signals that are provided from the location detector 11, and provides the calculated x and y values to the control circuit 2. The output circuit 10 previously stores data as look-up table or function for converting the location signals that are provided from the location detector 11 into x and y values. The output circuit calculates x and y values based on the provided location signals, and provides the calculated x and y values to the control circuit 2.

In addition, the input device 3 shown in FIG. 1 includes the use input portion 7 and a light intensity input device 12. The use input portion accepts an input for specifying a use type of the illumination system. The light intensity input device 12 accepts an input for specifying the total light intensity of the illumination system. The use input portions 7 includes a plurality of press-button switches 7A corresponding to different use types. The different use types are indicated on the press-button switches 7A. The press-button switches 7A are connected to the limiter circuit 5 so that a signal is provided to the limiter circuit 5 whereby specifying a use type of the illumination system. The press-button switches 7A are non-lock buttons, and provide an ON signal when pressed (short hold). Thus, the limiter circuit 5 receives the signal specifying a use type of the illumination system. The signal from the press-button switch 7A is also transmitted to the calculator circuit 4.

In the case where the users can check the display of the display portion 15 and change the total light color and the total light intensity of the LEDs in the illumination system, when the press-button switch is pressed and held (long hold), the scene memory stores the total light color and the total light intensity of the LEDs under the conditions where the press-button switch is pressed and held. In this illumination system, when users press the press-button switch (short hold) corresponding to the press-button switch that has been pressed and held (long hold), the total light color and the total light intensity that are stored in the scene memory can be reproduced. In the case where the illumination system includes a plurality of press-button switches, the total light color and the total light intensity can be stored by selectively pressing and holding one of the plurality of press-button switches so that a plurality of users can reproduce their favorite total light colors and total light intensities by pressing the press-button switches (short hold) corresponding to their favorite illumination conditions.

If the data that is changed in the display portion 15 agrees with data that has been stored in the scene memory 16, the press-button switch 7A corresponding to the changed data can illuminate for indicating tally information. Alternatively, although the number of the items of control data is reduced, the press-button switches may be lock buttons.

The press-button switches 7A may be replaced by a rotary switch, DIP switch, or slider switch with a plurality of contacts. In this case, LED lamps can be used for indicating tally information.

The light intensity input device 12 detects the number of revolutions, rotational angle or the position of linear slider, and provides an electric signal corresponding to the detection. The light intensity input device 12 can be a rotary encoder, variable resistor, or a device that can detects the number of revolutions, rotational angle or the position of linear slider, and provide a digital signal corresponding to the detection. Although is not illustrated, the light intensity input device 12 may be constructed of press-button switches for increasing and decreasing the total light output of the illumination system. In the case of the light intensity input device constructed of press-button switches, when users press the press-button switch, the light output is increased or decreased at a certain ratio so that the total light output is specified. Although not illustrated, the light intensity input device constructed of press-button switches can include a display portion (not shown) that indicates the specified total light color.

The aforementioned illumination system can be used as follows.

1. Users operate the use input portion 7, and enter a use type of the illumination system. In addition, users operate the light intensity input device 12, and enter a total light output. The control circuit 2 receives signals corresponding to the entered use type and total light output.
2. Users operate the color-point pointer 9, and specify a color point P in the chromaticity diagram, which is displayed on the color display portion 8. As a result, x and y values corresponding to the specified color point P are provided to the control circuit 2.

1. The calculator circuit 4 in the control circuit 2 calculates control data based on the use type, the total light output and the x and y values for specifying the color point P that are provided from the input device 3, and the limiter signals that are provided from the limiter circuit 5. The control data is provided to the driver circuit 6. Thus, the LEDs 1 are driven based on the calculated control data so that light outputs corresponding to the calculated control data are emitted. In the case where the calculator circuit 4 is connected to the scene memory 16 in the control circuit 2, the calculator circuit reads scene data that is stored in the scene memory 16, and calculates control data. If the maximum outputs at the light emission peak wavelengths of the LEDs 1 to be emitted in accordance with the control data that is calculated by the calculator circuit 4 are smaller than the values corresponding to limiter signals that are provided by the limiter circuit 5, the LEDs 1 are driven based on the calculated control data so that light outputs corresponding to the calculated control data are emitted without limiting the light outputs of the LEDs 1 to the values corresponding to the limiter signals.

When the calculator circuit 4 adjusts the light outputs of the LEDs 1 so that the total light color and the total light output of the illumination system are adjusted to the light color and the light output that are specified by the input device 3, if the light output of any of the LEDs 1 exceeds the value corresponding to the limiter signal, the calculator circuit calculates control data so that the light output at the peak wavelength of this LED 1 does not exceed the value corresponding to the limiter signal. Thus, the LEDs 1 are driven based on this calculated control data so that light outputs corresponding to this calculated control data are emitted.

During light emission of the LEDs 1, the light output detection circuit 14 detects the total light color, and provides the detected total light color as feedback to the control circuit 2. The calculator circuit 4 in the control circuit 2 compares signals i.e., x and y values (or RGB values) of the total light color as well as the luminance level of the illumination system that are provided from the feedback circuit with the x and y values (or RGB values) corresponding to the color point, and light intensity that are provided from the input device 3. The calculator circuit 4 corrects and controls light outputs of the LEDs 1 so that the x and y values (or RGB values) of the total light color as well as the luminance level of the illumination system are adjusted to the x and y values (or RGB values) corresponding to the color point, and light intensity that are provided from the input device 3.

In the case of the use type of the illumination system where the color point P is not required to be accurately specified, when the total light color and the total light output of the illumination system are adjusted to the light color and total light output that are provided from the input device 3, if the light output at the peak wavelength of any of the LEDs 1 exceeds the value corresponding to the limiter signal, the calculator circuit 4 may calculate control data that slightly changes the total light color of the illumination system from the color point P, which is specified by the input device 3, or slightly changes the total light color of the illumination system from the specified color point P while limiting the total light output so that light outputs of the LEDs 1 are adjusted based on the calculated control data.

In the illumination system shown in FIG. 1, the input device 3 is connected to the control circuit 2 through lead wire lines so that signals are sent from the input device 3 to the control circuit 2 through the lead wire lines. In the case where the illumination system as shown in FIG. 1 is connected to the external connection device 18 through the interface circuit 17, signals can be wirelessly sent from the external connection device to the control circuit through the interface circuit 17. Mobile phones and smart phones capable of displaying the chromaticity diagram in full color can be used as an input device of the external connection equipment 18 with wireless communication function. In the mobile phone or smart phones used as the input device of the external connection device 18, the chromaticity diagram is displayed in full color on the display portion of the phone. The phone detects the location that is specified by the user on the chromaticity diagram, and determines the x and y values of the color point in accordance with the detected location. Subsequently, the phone can wirelessly send the x and y values to the control circuit. The memory of the mobile phone or smart phone stores the software for displaying the full color chromaticity diagram on the display portion and determining x and y values in accordance with the specified location on the chromaticity diagram. In the mobile phone or smart phone which is used as the input device, the output circuit is not necessarily included in the phone. The output circuit can be included in the control circuit. In this case, the location signals of the color point can be wirelessly sent to the output circuit, and the output circuit can determine the x and y values in accordance with the location signals and detect the specified light intensity. Subsequently, the output circuit can provide the x and y values, and light intensity to the control circuit. In this illumination system, the memory of the mobile phone or smart phone does not necessarily store the software for determining the x and y values, and the specified light intensity. In the case where the illumination system includes the mobile phone or smart phone as the input device, it is convenient since the total light color of the LEDs can be controlled from remote locations.

An illumination system according to the present invention can suitably serve to control light outputs of LEDs with different light colors whereby adjusting the light color of the illumination system to various colors.

The invention claimed is:

1. An illumination system comprising:

LEDs that emit light in different colors;

a control circuit that controls light intensities of the LEDs; and an input device that is connected to said control circuit and accepts an input corresponding to a total light color to be obtained by mixing the light colors of the LEDs, wherein said input device further comprises a color display portion that displays a chromaticity diagram in color, a color-point pointer that specifies a color point in the chromaticity diagram, which is displayed on said color display portion, and an output circuit that detects the coordinates of the color point, which is specified by said color-point pointer, and provides the detected coordinates to said control circuit, wherein said control circuit further comprises a limiter circuit that provides a limiter signal for limiting the maximum output at the peak wavelength of the LED, and a calculator circuit that calculates light outputs of the LEDs based on the coordinates, which are provided from said input device and the limiter signal, which is provided from said limiter circuit, wherein said control circuit is configured to control light outputs of the LEDs based on the coordinates, which are provided from said input device, and the limiter signal, which is provided from said limiter circuit, whereby adjusting the total light color of the LEDs to the color point, which is specified by the color-point pointer of said input device.

2. The illumination system according to claim 1, wherein said input device includes a use input portion that accepts an input for specifying a use type of the illumination system, and said limiter circuit stores limiter signals of the LED corresponding to use types to be provided from said use input device, wherein light outputs of the LEDs are controlled based on the limiter signal that is selected corresponding to the use type that is specified in said use input portion from the limiter signals stored in said limiter circuit.

3. The illumination system according to claim 1, wherein said input device includes a light intensity input device that accepts an input for specifying a total light intensity of said LEDs, wherein light outputs of the LEDs are controlled based on a light intensity signal that corresponds to the input and is provided from said light intensity input device, x and y values that are provided as the coordinates from said input device, and the limiter signal, which is provided from said limiter circuit.

4. The illumination system according to claim 1 further comprising a light output detection circuit that detects the total light color of said LEDs, wherein said control circuit includes a feedback circuit that compares the total light color that is detected by said light output detection circuit with the color point, which is specified by said input device, whereby correcting the total light color of said LEDs to the color point, which is specified by said input device.

5. The illumination system according to claim 1, wherein said chromaticity diagram is the x-y chromaticity diagram, and the coordinates are x and y values.

6. The illumination system according to claim 1, wherein said chromaticity diagram is the UCS diagram, and the coordinates are u and v values.

7. The illumination system according to claim 1, wherein said color-point pointer includes a photo sensor that detects red, green and blue components of a specified area in said color display portion, and the red, green and blue components, which are detected by said photo sensor, are provided as the coordinates to the control circuit.

8. The illumination system according to claim 1 further comprising a diffusion plate that is arranged on the light-outgoing side relative to said LEDs and diffuses light that is emitted by the LEDs.

9. The illumination apparatus according to claim 1, wherein said LEDs includes red, green, and blue light color LEDs.

10. The illumination apparatus according to claim 1, wherein said LEDs includes white, red, green, and blue light color LEDs.

* * * * *